US008256619B2

(12) United States Patent
Lebauer et al.

(10) Patent No.: US 8,256,619 B2
(45) Date of Patent: Sep. 4, 2012

(54) CONVERTIBLE CONTAINER FOR ELECTRONIC DEVICES

(76) Inventors: Ian F Lebauer, Maple Lake, MN (US); Nick Larson, Bloomington, MN (US); Bruce J Gibis, Eden Prairie, MN (US); Gerardo DeCuffa, West Saint Paul, MN (US); Mark Mandel, Victoria, MN (US)

( * ) Notice: Subject to any disclaimer, the term of this patent is extended or adjusted under 35 U.S.C. 154(b) by 0 days.

(21) Appl. No.: 12/500,223

(22) Filed: Jul. 9, 2009

(65) Prior Publication Data

US 2010/0006473 A1 Jan. 14, 2010

Related U.S. Application Data

(60) Provisional application No. 61/134,541, filed on Jul. 11, 2008.

(51) Int. Cl.
*B65D 71/00* (2006.01)

(52) U.S. Cl. ..... 206/579; 206/736; 206/756; 206/759; 206/747; 206/45.26; 206/752; 248/917

(58) Field of Classification Search ..... 206/759, 206/747, 752, 754, 756, 45.2, 45.24, 45.23, 206/736, 301; 248/183.1, 917, 921; 361/679.27
See application file for complete search history.

(56) References Cited

U.S. PATENT DOCUMENTS 4,424,899 A * 1/1984 Rosenberg ..... 206/305
5,350,147 A * 9/1994 Paganus ..... 248/346.2
6,129,321 A 10/2000 Minelli et al.
6,673,409 B1 1/2004 Wheatley
6,772,879 B1 * 8/2004 Domotor ..... 206/45.23
7,125,602 B2 10/2006 Wheatley
7,142,980 B1 11/2006 Laverick et al.
7,252,867 B2 8/2007 Wheatley
7,313,477 B1 12/2007 Laverick et al.
D565,980 S 4/2008 Reeson et al.
D566,590 S 4/2008 Stevens et al.
7,363,148 B1 4/2008 Laverick et al.
7,380,759 B1 6/2008 Whiteside et al.
7,440,845 B1 10/2008 Laverick et al.
7,516,928 B2 4/2009 Kalis et al.
2007/0151899 A1 * 7/2007 Chun ..... 206/775
2007/0235492 A1 * 10/2007 Sirichai et al. ..... 224/930

* cited by examiner

*Primary Examiner* — David Fidei
*Assistant Examiner* — Raven Collins
(74) *Attorney, Agent, or Firm* — Leffert Jay & Polglaze, P.A.

(57) ABSTRACT

A container for an electronic device has pivotally coupled first and second portions. The first portion is configured to house the electronic device and has an opening for receiving the electronic device and for displaying the electronic device when the container is configured in a first configuration. The second portion is configured to act as a mount for mounting the container on a surface when the container is configured in the first configuration and the first portion is displaying the electronic device. The second portion is further configured to cover the opening in the first portion, and thus the electronic device, when the container is configured in a second configuration.

21 Claims, 6 Drawing Sheets

CONVERTIBLE CONTAINER FOR ELECTRONIC DEVICES

CROSS REFERENCE TO RELATED APPLICATION

This application is related to and claims the benefit of the filing date of co-pending provisional application U.S. Ser. No. 61/134,541, titled, "PORTABLE PROTECTIVE CONTAINER AND VEHICLE MOUNTING APPARATUS FOR ELECTRONIC DEVICES," filed on Jul. 11, 2008, which application is incorporated herein by reference.

FIELD

The present disclosure relates generally to containers and in particular the present disclosure relates to a convertible container for electronic devices that can be converted between a first configuration for displaying and mounting the electronic device and a second configuration for storing and/or transporting the electronic device.

BACKGROUND

One purpose of a container (e.g. a case) for an electronic device is to protect the device from wear and to help protect the device from shock if the case with the electronic device therein is dropped. Generally, such containers are designed to be lightweight so that a user can easily transport the device comfortably, without strain. Containers for electronic devices are numerous and varied in design. For example, some containers may include carrying handles, structural portions, and purposeful cushioning areas, all of which enable the user to more safely transport the electronic device without damage.

One purpose of a vehicle mounting apparatus for an electronic device is to affix the electronic device, either temporarily or permanently, in or on a vehicle, such as an automobile, for the purpose of allowing the electronic device to be viewed, heard, or physically operated. Prior art shows that electronic devices are typically secured to the dashboard, floor, or windshield, or other surfaces of an automobile, using suction cups, adhesive tape, screws, plastic clips, or any other type of fasteners known in the art. Some of these fasteners result in permanent mounting of the electronic device.

Permanent mounting of devices has several drawbacks, such as preventing the user from moving the device to an alternate vehicle and preventing the user from retaining the electronic device if and when the user dispossesses the vehicle. Additionally, the permanent mounting of electronic devices in a vehicle, if attempted to be undone, almost inevitably results in damage to the surface of the vehicle where mounting hardware was affixed. For example, screw-holes or non-removable adhesive residue may be left in or on the mounting surface. This can lower re-sale value and is usually forbidden on leased vehicles.

Non-permanent mounting apparatus for electronic devices thus have merit over permanent mounting apparatus but, nevertheless, still have there own drawbacks. Prior art shows that non-permanent mounting apparatus for electronic devices are typically large and/or heavy, sometimes 2 to 3 times larger than the average size of the electronic device and sometimes 4 to 5 times heavier than the electronic device. The relative size and weight of the non-permanent mounting device allows the non-permanent mounting device to non-permanently affix the electronic device in or on the automobile and to have some portability for moving the device and mounting apparatus to an alternative vehicle. However, the non-permanent mounting apparatus shown in the prior art offer no protection to the electronic device when being transported and offer no ability to safely transport the electronic device, via airplane, train, etc., without potential damage. Additionally, the relative size and weight of the non-permanent mounting apparatus shown in the prior art prevents the non-permanent mounting apparatus from being suitably comfortable or purposeful for transporting the electronic device and mounting apparatus.

For the reasons stated above, and for other reasons stated below which will become apparent to those skilled in the art upon reading and understanding the present specification, there is a need in the art for alternative containers for devices, such as electronic devices, and mounting equipment therefore.

SUMMARY

Figure 1:
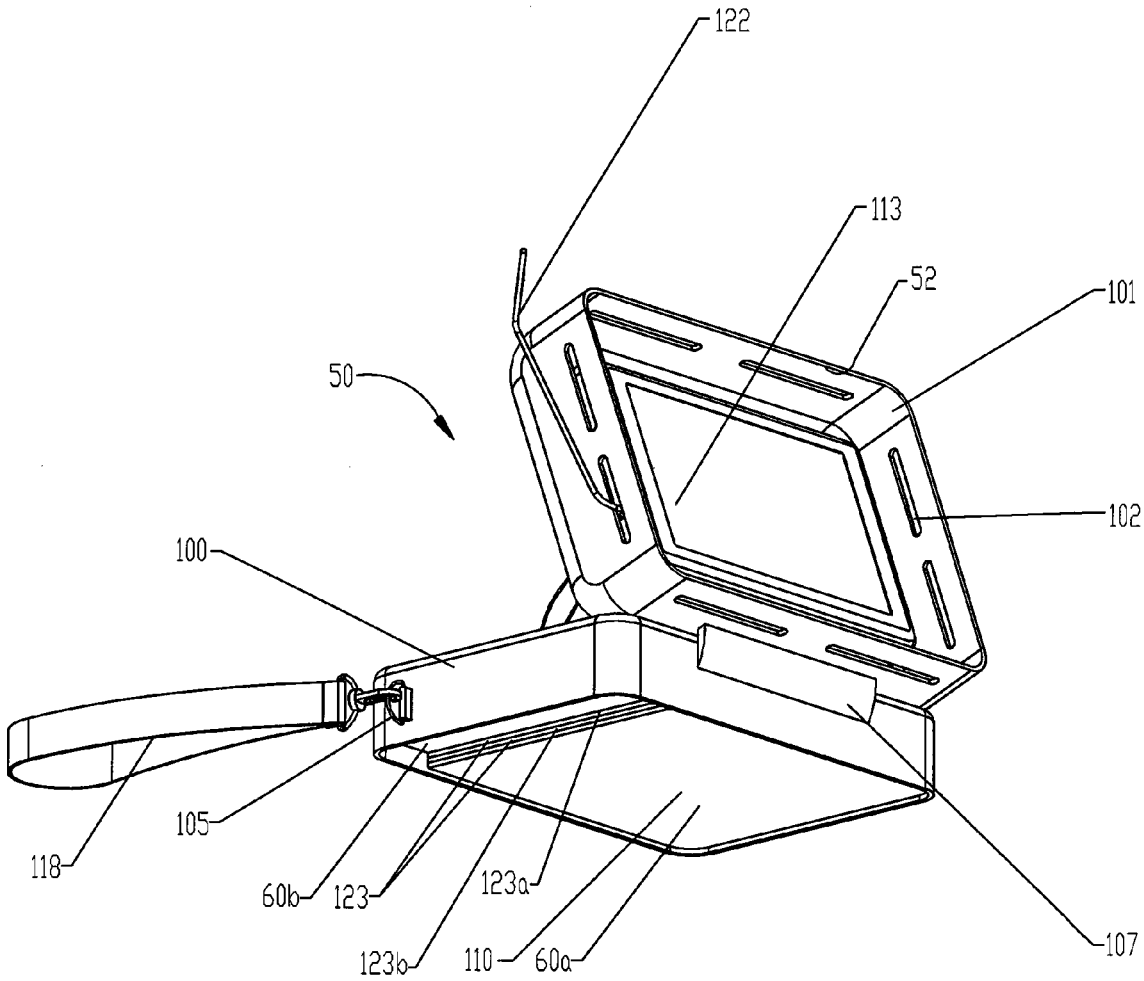
FIG. 1 is a front isometric view of a container for an electronic device in a first mode of use for displaying the electronic device, according to an embodiment.

One embodiment of the disclosure provides a container for an electronic device, including pivotally coupled first and second portions. The first portion is configured to house the electronic device and has an opening for receiving the electronic device and for displaying the electronic device when the container is configured in a first configuration. The second portion is configured to act as a mount for mounting the container on a surface when the container is configured in the first configuration and the first portion is displaying the electronic device. The second portion is further configured to cover the opening in the first portion, and thus the electronic device, when the container is configured in a second configuration.

DETAILED DESCRIPTION

In the following detailed description, reference is made to the accompanying drawings that form a part hereof, and in which is shown, by way of illustration, specific embodiments. In the drawings, like numerals describe substantially similar components throughout the several views. Other embodiments may be utilized and structural changes may be made without departing from the scope of the present disclosure. The following detailed description is, therefore, not to be taken in a limiting sense, and the scope of the present disclosure is defined only by the appended claims and equivalents thereof.

FIG. 1 is a front isometric view of a container 50 (e.g., a case), such as a portable container, for an electronic device 113, such as a portable electronic device, according to an embodiment. Non-limiting examples of electronic devices that may be used with container 50 include global positioning systems, radios, cellular telephones, two-way radios, personal digital assistants, mp3 players, etc.

Figure 2:
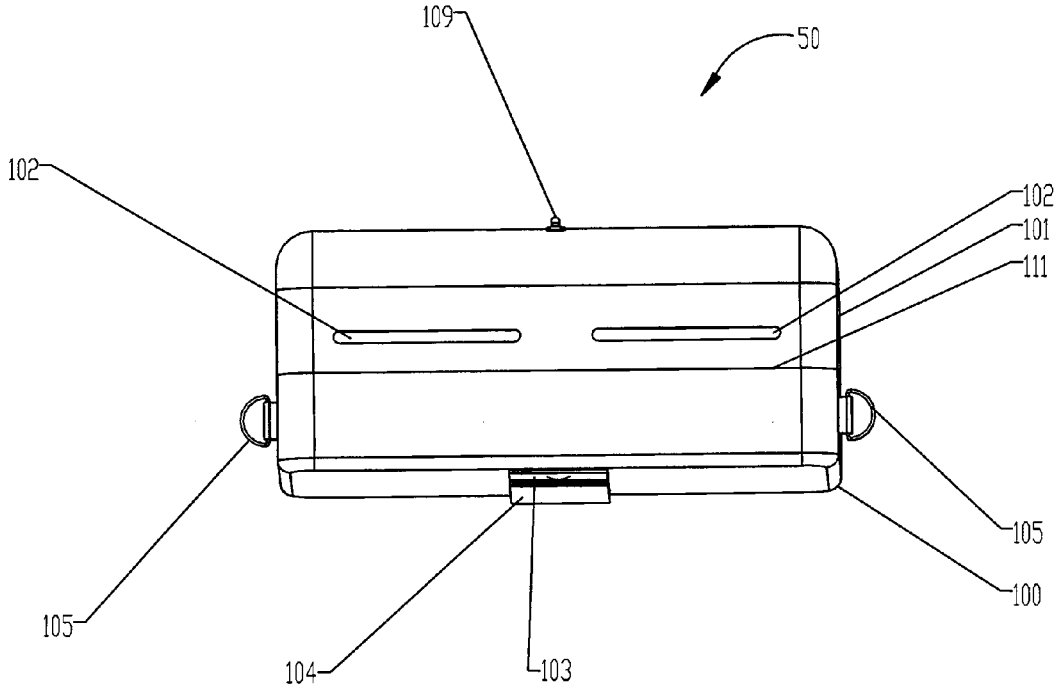
FIG. 2 is a front view illustrating the container for an electronic device in a second mode of use for storing and/or transporting the electronic device, according to another embodiment.

FIG. 1 illustrates container 50 in a first mode of use (e.g., an open configuration) for displaying electronic device 113. FIG. 2 is a front view illustrating container 50 in a second mode of use (e.g., a closed configuration) for storing and/or transporting electronic device 113. In the closed configuration, container 50 covers and cushions electronic device 113 and protects electronic device 113 from wear and shock. As such, container 50 is convertible in that it can be converted between the open and closed configurations.

Figure 3:
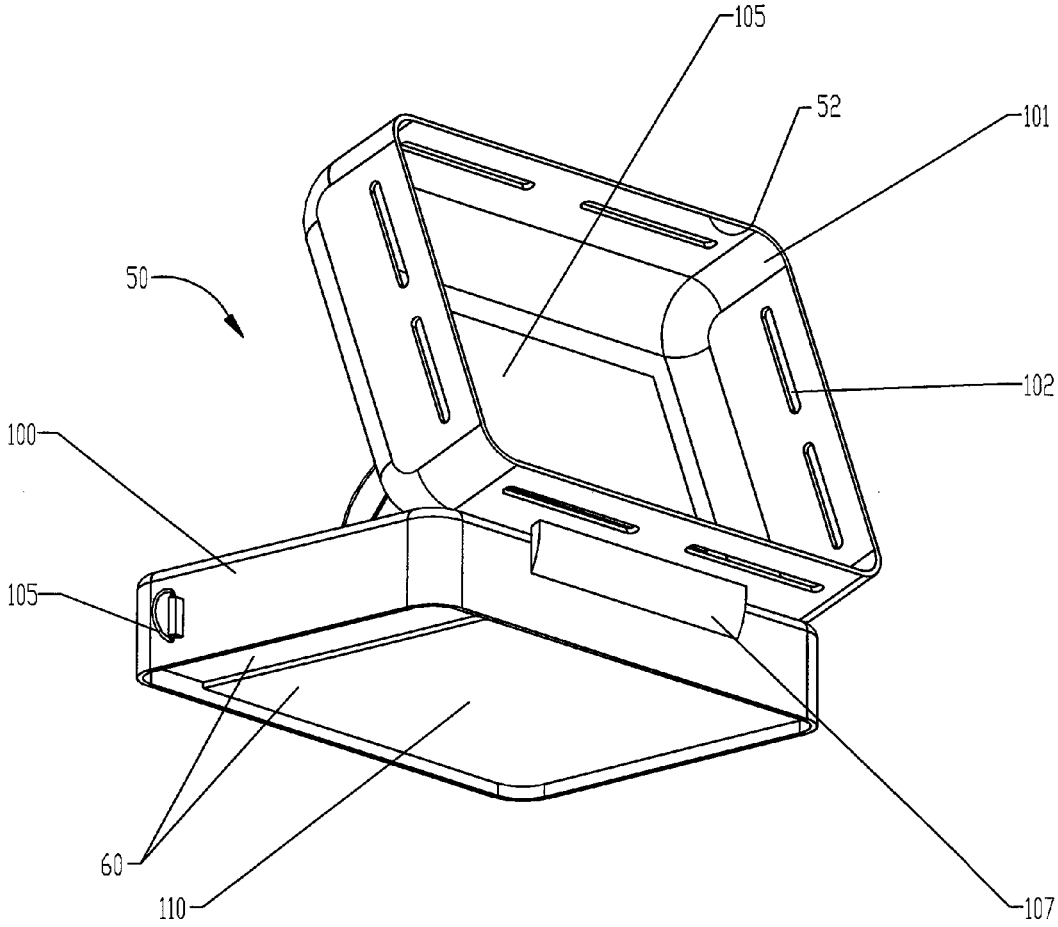
FIG. 3 is a front isometric view of the container for an electronic device in the first mode of use with the electronic device removed, according to another embodiment.

Container 50 includes a portion (e.g., a housing) 100 and a portion (e.g., a housing) 101 pivotally coupled to housing 100 by a hinge 107, as shown in FIG. 1 and in FIG. 3, a front isometric view of container 50 with electronic device 113 removed. For one embodiment, each of housings 100 and 101 is substantially half of container 50.

Figure 4:
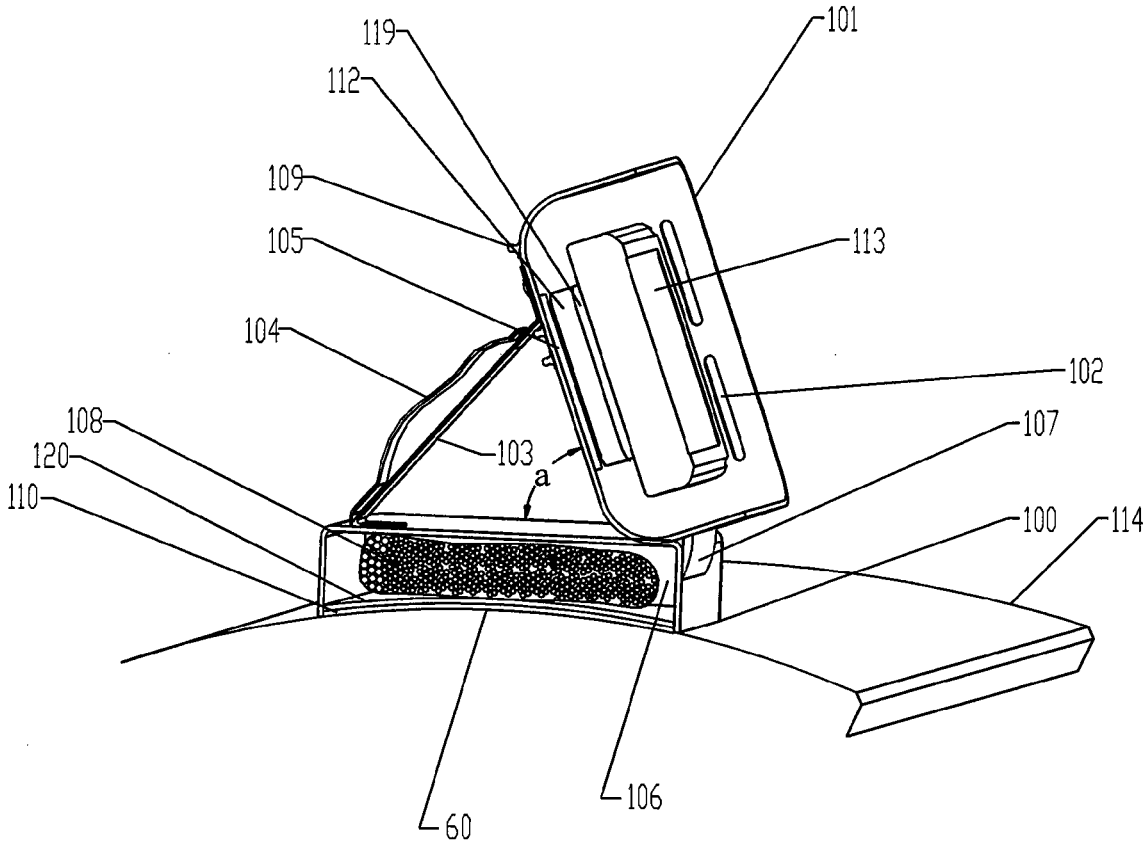
FIG. 4 is a cutaway view taken along line 4-4 of FIG. 5, according to another embodiment.
Figure 5:
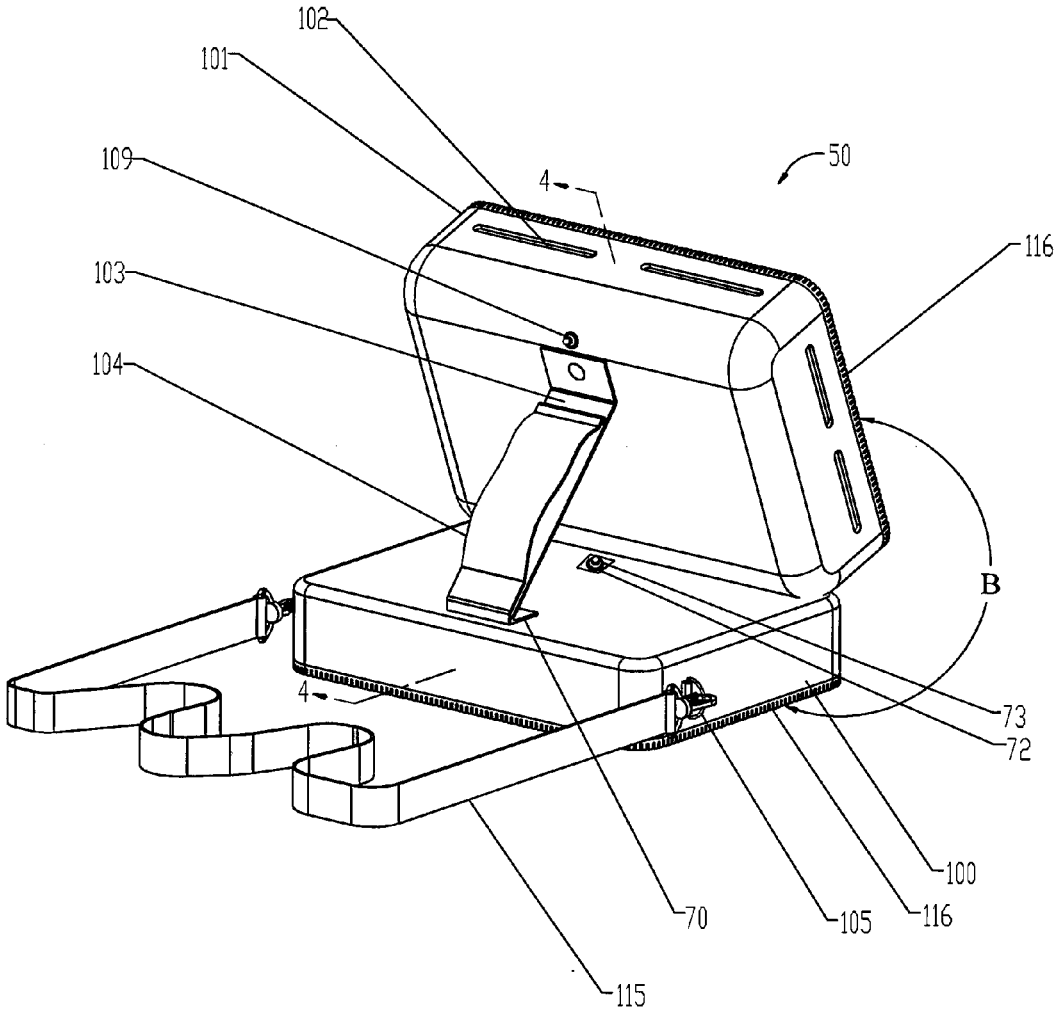
FIG. 5 is a rear isometric view of the container for an electronic device in the first mode of use, according to another embodiment.
Figure 6:
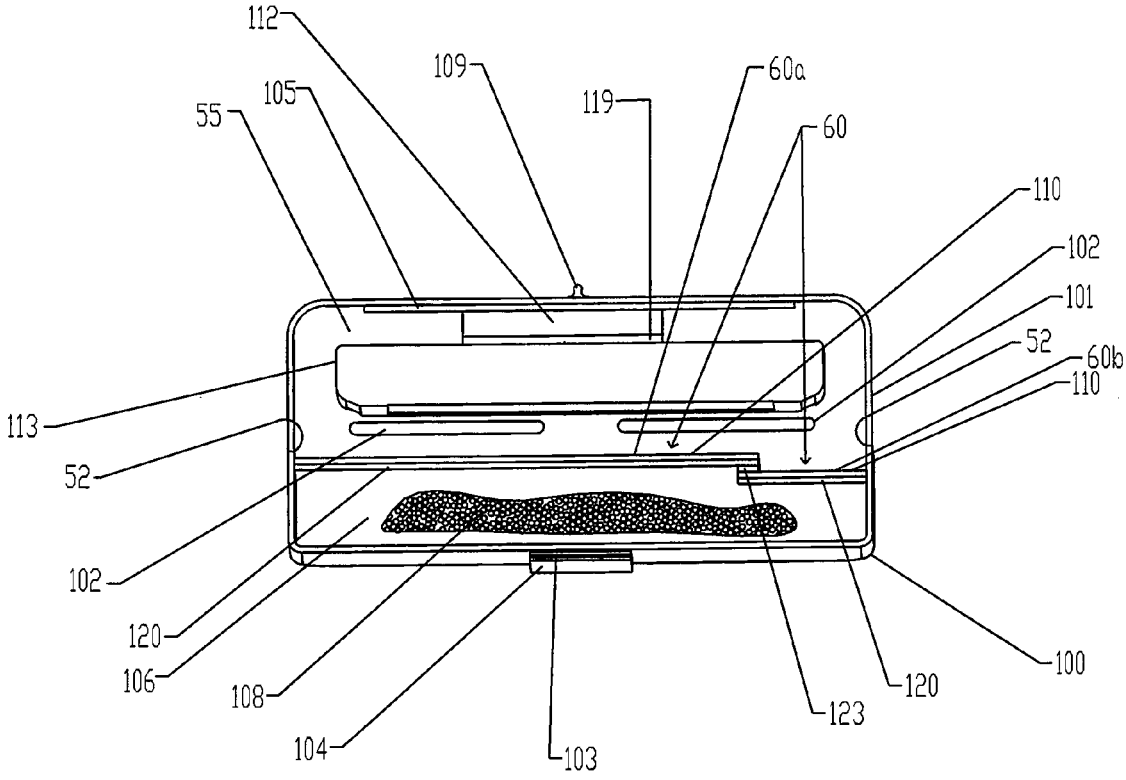
FIG. 6 is a cross-sectional view, parallel to the front view of FIG. 2, of the container for an electronic device in the second mode of use, according to another embodiment.

Housing 101 is configured to house electronic device 113 and has an opening 52 for receiving electronic device 113 and for displaying electronic device 113 when container 50 is configured in the open configuration, as shown in FIGS. 1 and 3. Housing 100 is configured to act as a mount for mounting container 50, and thus electronic device 113, on a surface 114, e.g., a surface within a motor vehicle, such as a dashboard, when container 50 is configured in the open configuration and housing 101 is displaying electronic device 113, as shown in FIG. 4. FIG. 4 is a cutaway view taken along line 4-4 of FIG. 5, a rear isometric view of container 50 in the open configuration. Housing 100 is further configured to cover the opening 52 in housing 101, and thus electronic device 113, when container 50 is configured in the closed configuration, as shown in FIG. 6, a cross-sectional view parallel to the front view of FIG. 2.

One or more (e.g., a pair of) connective loops 105, such as D-rings, may be attached to housing 100, e.g., by stitching or the like, as shown in FIG. 2, for attaching carrying handles and/or carrying straps to container 50. For example, a wrist strap 118 may be removably attached to container 50 by removably clipping a clip at one end of wrist strap 118 to a loop 105, as shown in FIG. 1. Alternatively, a shoulder strap 115 may be removably attached to container 50 by removably clipping clips at the ends of shoulder strap 115 to the loops 105, as shown in FIG. 5. For one embodiment, a fastener, such as a zipper 116 (FIG. 5), hook-and-loop material, etc., is used to fasten housings 100 and 101 together along a seam 111 (FIG. 2) when container 50 is configured in the closed configuration.

One or more openings 102 (e.g., slots) may be formed in sidewalls of housing 101, e.g., around a perimeter of housing 101. Openings 102 serve as access ports to electronic device 113 and are configured to pass cords, such as one or more cords 122 (FIG. 1), from the electronic device to an exterior of the container 50, e.g., for connecting electronic device 113 to a power source or user accessories, such as headphones.

For one embodiment, housings 100 and 101 may be formed from a soft, compliant material, such as vinyl. Alternatively, housings 100 and 101 may be formed from a hard, non-compliant material, such as aluminum, hard plastic, molded ethylene vinyl acetate (EVA) foam, or the like, to afford greater protection to electronic device 113.

Housing 101 includes a fastener, such as adhesive tape, contoured foam, elastic straps, hook-and-loop material, or the like configured to attach electronic device 113 within housing 101. For one embodiment, the fastener may be configured to removably attach electronic device 113 within housing 101.

For example, for one embodiment, the fastener may include a patch 105 (FIGS. 3, 4, and 6) of hook material permanently affixed to a bottom interior surface of housing 101, e.g., by gluing, stitching, or the like, and a tape 119 of loop material backed by an adhesive for removably or permanently affixing the loop material to a rear surface of electronic device 113 so that tape 119 can removably attach to patch 105. An optional spacer 112 may be interposed between patch 105 and tape 119, as shown in FIGS. 4 and 6. For example, spacer 112 may have loop material on one surface for removably engaging the hook material of patch 105 and hook material on an opposite surface for removably engaging the loop material of tape 119. Alternatively, patch 105 may be loop material and tape 119 may be hook material in which case spacer 112 would be inverted. Spacer 113 acts to form a space 55 (FIG. 6) between the rear surface of electronic device 113 and patch 105 for passing cords between the rear surface of electronic device 113 and patch 105.

Alternatively, patch 105 may be adhesive tape or contoured foam for directly removably or permanently attaching to the rear surface of electronic device 113. In addition, optional spacer 112 may have an adhesive disposed on one or both of its surfaces for removably or permanently attaching to patch 105 and thus to the rear surface of electronic device 113.

For one embodiment, a portion of housing 100 is covered by an anti-skid material 110 that is exposed and that forms a bottom surface of container 50 when container 50 is configured in the open configuration, as shown FIGS. 1, 3, and 4. For one embodiment, anti-skid material 110 may also provide cushioning to cushion electronic device against shock.

Material 110 frictionally engages the surface 114 when housing 100 is acting as a base for mounting container 50 on surface 114. Anti-skid material 110 may be compliant so as to conform to a contour of surface 114 when in frictional engagement with surface 114, as shown in FIG. 4. A non-limiting example of a suitable material 110 is expanded foam with a synthetic or natural rubber additive.

Anti-skid material 110 may include roughness elements, e.g., embossed on anti-skid material 110, for further increasing the friction between container 50 and surface 114. Anti-skid material 110 may be disposed on a fabric backing 120 (FIGS. 4 and 6) that has a relatively low coefficient of friction. Note that when container 50 is configured in the closed configuration, anti-skid material 110 faces electronic device 113, as shown in FIG. 6.

For one embodiment, anti-skid material 110 forms a bounding wall 60 of a pocket 106 within an interior of housing 100, as shown in FIGS. 4 and 6. Bounding wall 60 may include a closure 123, e.g., snaps, hook-and-loop material, a zipper, etc, for selectively closing an opening (shown as closed in FIGS. 1, 4, and 6) formed in bounding wall 60 between portions **60*a* and 60*b* of wall 60. For example, closure 123 may include hook material 123*a* affixed to wall portion 60*a* and loop material 123*b* affixed to wall portion 60*b*, as shown in FIG. 1**, or vice versa.

Closure 123 configures pocket 106 to removably contain a weight 108, as shown in FIGS. 4 and 6. That is, weight 108 can be inserted into and removed from pocket 106 through the opening formed in bounding wall 60 between portions **60*a* and 60*b* of wall 60. Alternatively, pocket 106 may be permanently closed, e.g., by stitching, so that weight 108 is permanently contained within pocket 106. However, it is desirable to be able to remove weight from pocket 106 to reduce weight to facilitate transporting case 50 in the closed configuration while containing electronic device 113**.

Weight 108 may be of sufficient weight to assist in holding the container on surface 114, e.g., about 24 oz. Note that weight 108 assists in holding the container on surface 114 by increasing the weight of container 50, and thus the friction between material 110 and surface 114.

Weight 108 may be of a malleable (e.g., compliant) material that can conform to the contour of surface 114, as shown in FIG. 4. For example, the compliant material may include hard, dense particles, such as steel particles, e.g., steel shot, contained in a bag that is disposed in pocket 106. Alternatively, the hard, dense particles may be disposed directly in pocket 106 for embodiments where pocket 106 is permanently closed.

Hinge 107 allows housings 100 and 101 to pivot relative to each other between their relative positions when the container is in the open configuration (FIGS. 1, 3, 4, and 5) and their relative positions when the container is in the closed configuration, with housing 100 covering opening 52 in housing 101 (FIGS. 2 and 6). For example, housings 100 and 101 can be pivoted apart by an angle B of about 300 degrees, as shown in FIG. 5.

For one embodiment, container 50 is configured so that an angle a formed between housings 100 and 101 when container 50 is configured in the open configuration, as shown in FIG. 4, is adjustable. For example, the angle a may range from about 15 to about 90 degrees.

A support 103 (e.g., a strap) may be selectively, removably connectable between housings 100 and 101 to selectively maintain container 50 in the open configuration. That is, support 103 may be permanently and pivotally attached to a location 70 on housing 100 (FIG. 5) and be selectively, removably attachable to one or more locations on housing 101. For example, the one or more locations on housing 101 may respectively correspond to one or more snaps 109 disposed on housing 101, as shown in FIGS. 4 and 5, so that support 103 can selectively, removably snap to the one or more snaps 109.

Note that selectively snapping support 103 to the different snaps acts to adjust angle a, and thus the display angle at which electronic device 113 is displayed. That is, snapping support to different ones of snaps 109 respectively sets housing 101 at a different angles a. Note further that the pivotal coupling of support 103 to housing 100 allows support 103 to be pivoted, relative to housing 100, to the different snaps 109.

As such, support 103 is configured to selectively, removably connect between different ones of the snaps 109 on housing 101 and location 70 on housing 100 for selectively maintaining (e.g. supporting or propping) housing 101 at respective ones of a plurality of pivot angles a with respect to housing 100, where each of the plurality of the pivot angles a defines a different configuration of the open configuration.

Alternatively, support 103 may be selectively, removably attached to housing 101 using hook-and-loop material. Note that the hook-and-loop material increases the number attachment locations on housing 101, resulting in essentially an infinite number of attachment locations and thus producing essentially an infinite number of angles a.

Support 103 may be selectively, removably connected between location 70 on housing 100 and a location 72 on housing 100 (FIG. 5), when container 50 is configured in the closed configuration. Note that support 103 can be selectively pivoted, with respect to housing 100, between the attachment locations on housing 101 and attachment location 72 on housing 100. A snap 73 and/or hook-and-loop material may be used to removably attach support 103 to location 72.

For another embodiment, a loop 104, e.g., of elastic, may be attached to support 103 for holding a power cord or other accessory of the electronic device. In addition, a user's belt may be threaded through loop 104 for attaching container 50 to the user for transporting container 50, and thus electronic device 113, when container 50 is configured in the closed configuration.

Support 103 may include a resilient material, such as resilient plastic, that is of sufficient rigidity for supporting housing 101, with electronic device 113 housed therein, without buckling. Alternatively, support 103 may be of a rigid material, such as hard plastic, aluminum, etc. The resilient or rigid material may be enclosed in fabric that permanently, pivotally attaches support 103 to housing 100, e.g. a portion of the fabric may be permanently stitched or riveted to housing 100.

To use container 50, electronic device 113 is attached (e.g., removably or permanently) within the interior of housing 101 so that electronic device 113 is visible through opening 52 in housing 101. Housing 101 is then pivoted with respect to housing 100 to a certain angle a between housings 100 and 101, as shown in FIGS. 1 and 4, into the open configuration (e.g., display mode of use). Housings 100 and 101 are then removably connected, using support 103, as shown in FIGS. 4 and 5, to maintain housing 101 at the certain angle a, thereby maintaining the container in the open configuration. Container 50 is then positioned on surface 114 to mount container 50, and thus electronic device 113, in the open configuration, on surface 114, so that anti-skid material 110 frictionally engages surface 114, as shown in FIG. 4.

Weight 108 may be inserted into pocket 106 within an interior of housing 100, as shown in FIG. 4, to increase the weight of container 50 and thus the friction between anti-skid material 110 and surface 114. One or more cords 122 may be passed through one or more openings 102 and connected to electronic device 113, as shown in FIG. 1. For one embodiment, spacer 112 may be positioned between electronic device 113 and patch 105 to form space 55 (FIG. 6) between the rear surface of electronic device 113 and patch 105, and the one or more cords 122 may be further passed through space 55 between the rear surface of electronic device 113 and patch 105.

To store or transport container 50, and thus electronic device 113, housing 101, with electronic device 113 attached within, is pivoted, with respect to housing 100, from the certain angle a until housing 100 covers opening 52 in housing 101, as shown in FIG. 6, to configure container 50 in the closed configuration (e.g., in a non-display mode of use). For one embodiment, portions of housings 100 and 101 may be fastened together, e.g., using zipper 116 or the like, when container 50 is configured in the closed configuration. For one embodiment, weight 108 may be removed from pocket 106 before housing 100 covers opening 52 and before fastening the portions of housings 100 and 101 together.

Various embodiments of the disclosure provide a portable, convertible container for an electronic device that can be converted between a first mode of use and a second mode of use. In the first mode of use, the container is configured to display the electronic device, e.g., for the purpose of allowing the electronic device to be viewed, heard, or physically operated, and to non-permanently mount the electronic device on a surface, such as a surface within a motor vehicle. In the second mode of use, the container covers the electronic device, allowing a user to comfortably and safely transport with the electronic device.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the embodiments will be apparent to those of ordinary skill in the art. Accordingly, this application is intended to cover any adaptations or variations of the embodiments. It is manifestly intended that the embodiments be limited only by the following claims and equivalents thereof.

What is claimed is:

1. A container for an electronic device, comprising:

pivotally coupled first and second portions;

wherein the first portion is configured to house the electronic device and has an opening for receiving the electronic device and for displaying the electronic device when the container is configured in a first configuration and when the electronic device is positioned within the first portion;

wherein the second portion is configured to act as a mount for mounting the container on a mounting surface when the container is configured in the first configuration and the first portion is displaying the electronic device positioned within the first portion, the second portion comprising a surface that faces and engages the mounting surface when the container is configured in the first configuration and the first portion is displaying the electronic device positioned within the first portion;

wherein the second portion is further configured to cover the opening in the first portion, and thus the electronic device positioned within the first portion, when the container is configured in a second configuration;

wherein the surface of the second portion that faces and engages the mounting surface when the container is configured in the first configuration faces the electronic device positioned within the first portion and is located within an interior of the container when the second portion covers the opening in the first portion when the container is configured in the second configuration; and wherein the surface of the second portion that faces and engages the mounting surface when the container is configured in the first configuration is a surface of a conformable wall of the second portion.

2. The container of claim 1, wherein the container is configured so that an angle formed between the first and second portions when the container is configured in the first configuration is adjustable.

3. The container of claim 1, further comprising a support that is selectively, removably connectable between the first and second portions to selectively maintain the container in the first configuration.

4. The container of claim 3, further comprising a loop affixed to the support for holding a power cord or other accessory of the electronic device or for receiving a user's belt therethrough when in the container is in the second configuration for attaching the container to the user for transporting the container.

5. The container of claim 3, wherein the support is further selectively, removably connectable between different ones of a plurality of locations on the first portion and a location on the second portion for selectively maintaining the first portion at respective ones of a plurality of pivot angles with respect to the second portion, wherein each of plurality of pivot angles defines a different configuration of the first configuration.

6. The container of claim 5, wherein the location on the second portion is a first location on the second portion and wherein the support is further selectively, removably connectable between the first location on the second portion and a second location on the second portion.

7. The container of claim 6, wherein the support is pivotally coupled to the first location on the second portion so that the support can be selectively pivoted between the second location on the second portion and the different ones of the plurality of locations on the first portion.

8. The container of claim 1, wherein the surface of the second portion comprises an anti-skid material for frictionally engaging the mounting surface when the container is configured in the first configuration.

9. The container of claim 1, wherein the second portion has an interior pocket configured to removably or permanently contain a weight.

10. The container of claim 9, wherein the weight comprises a malleable material.

11. The container of claim 9, wherein the pocket comprises a closure configured to selectively close an opening of the pocket.

12. The container of claim 1, further comprising a fastener configured to selectively fasten portions of the first and second portions together when the container is configured in the second configuration.

13. The container of claim 1, further comprising a wrist strap removably attachable to the container and/or a shoulder strap removably attachable to the container.

14. The container of claim 1, further comprising one or more access ports in the first portion configured to pass one or more cords from the electronic device to an exterior of the container.

15. The container of claim 1, further comprising a fastener configured to removably attach the electronic device within the first portion.

16. The container of claim 15, wherein the fastener comprises:

a first fastening portion attached to the first portion of the container; and a second fastening portion that is removably attachable to the first fastening portion and that is attachable to the electronic device.

17. The container of claim 16, further comprising a spacer interposable between the first and second fastening portions.

18. A container for an electronic device, comprising:

a first housing configured to removably contain the electronic device and having an opening for displaying the electronic device when the container is configured in an open configuration;

a second housing pivotally coupled to the first housing, wherein the second housing is configured to form a base of the container for mounting the container on a mounting surface when the container is configured in the open configuration and the first portion is displaying the electronic device, the second housing comprising a conformable wall that engages the mounting surface when the container is configured in the open configuration, where the conformable wall conforms to a contour of the mounting surface when in engagement with the mounting surface;

wherein the second housing is configured to cover the opening in the first housing, and thus the electronic device, when the container is configured in a closed configuration; and wherein the second housing is configured to removably contain a weight for increasing a frictional force between the conformable wall of the second housing and the mounting surface when the container is in the open configuration and the conformable wall is in engagement with the mounting surface.

19. The container of claim 18, wherein the container is configured so that an angle formed between the first and second housings when the container is configured in the open configuration is adjustable.

20. The container of claim 1, wherein the conformable wall conforms to a contour of the mounting surface when the surface of the conformable wall engages the mounting surface.

21. The container of claim 1, wherein the conformable wall of the second portion is a bottom conformable wall of the second portion when the container is configured in the first configuration, and wherein the second portion further comprises:

a top wall;

sidewalls coupled to the top wall and the bottom conformable wall; and a pocket between the bottom conformable wall and the top wall and bounded by the bottom conformable wall, the top wall, and the sidewalls.

* * * * *